US005457936A

United States Patent [19]

Neel

[11] Patent Number: 5,457,936

[45] Date of Patent: Oct. 17, 1995

[54] CAP TIGHTENING TURRET

[76] Inventor: Gordon M. Neel, 4019 Ward Rd., Lakeland, Fla. 33809

[21] Appl. No.: 225,572

[22] Filed: Apr. 11, 1994

[51] Int. Cl.[6] ..... B67B 3/20; B65B 7/28

[52] U.S. Cl. ..... 53/317; 53/331.5

[58] Field of Search ..... 53/367, 317, 331.5, 53/306, 308

[56] References Cited

U.S. PATENT DOCUMENTS

| | | | |
|---|---|---|---|
| 3,771,284 | 11/1975 | Boeckmann et al. | 53/331.5 X |
| 4,098,053 | 7/1978 | Shank | 53/367 X |
| 4,098,059 | 7/1978 | Chattillion | 53/367 X |
| 4,939,890 | 7/1990 | Peronek et al. | 53/486 |
| 5,016,422 | 5/1991 | Popp et al. | 53/330 |
| 5,095,681 | 3/1992 | Choi | 53/306 |
| 5,150,559 | 9/1992 | Winfield | 53/367 X |

*Primary Examiner*—Horace M. Culver
*Attorney, Agent, or Firm*—David L. Baker; Henry S. Miller; Rhodes & Ascolillo

[57] ABSTRACT

An improved cap tightening turret is of the type which includes a plurality of cap tightening spindles. The cap tightening spindles are mounted around the outer periphery of the turret. The turret includes a number of pedestals for respectively supporting a plurality of containers. Each of the spindles is for supporting a cap with each pedestal for movement of the neck of the container thereon into the spindle for causing the cap to be tightened by rotation onto the container. Each of the containers has an outwardly extending handle. A first type of container has the handle thereof disposed at a first radial distance thereon and a second type of container has a handle thereof disposed at a second radial distance thereon with the second radial distance being larger than the first radial distance. The improvement includes a single rotational prevention element mounted on each spindle. The single rotational prevention element extends towards the container for circumferential abutting alignment only with the handle thereof. The rotational prevention element includes selective adjustment means for selectively adjusting a relative radial position thereof with respect to the spindle to a first position for alignment with the handles of the first type of container and to a second position for alignment of the handle of the second type of container.

12 Claims, 4 Drawing Sheets

CAP TIGHTENING TURRET

BACKGROUND

1. Field of the Invention

Cap tightening turrets are used in the mass production bottling and capping of fluid containers. The present invention relates to an improved cap tightening turret of the type which includes a plurality of spindles for rotationally applying caps to bottles which are supported by a plurality of pedestals. The bottles have an outwardly extending handle thereon. The improvement includes a single rotational prevention element. mounted on each spindle for abutting alignment with the handle to prevent rotation of the bottle during the application of the cap to the bottle.

2. Description of the Related Art

There are provided in the prior art a number of container filling devices which include means for advancing the container toward a cap tightening turret. Typically, such cap tightening turrets include means for supporting the containers and a series of aligned container cap tightening spindles. The relative distance between the cap tightening spindle and the container is reduced to allow the cap tightening spindle to rotate the cap for installation on the top of the container. Although the preferred improved cap tightening turret is intended for use with eccentric but generally cylindrical containers having outwardly extending handles thereon, there have been provided a number of cap tightening turret configurations for different containers which have heretofore been employed throughout the prior art.

U.S. Pat. No. 5,016,422 discloses apparatus for screwing heavy lids on thick wall receptacles in order to avoid damaging the threads thereof and includes a stationary member centered on the receptacle with an axial movable platform which is guided such that torques can be transmitted and the common axis always remains the same.

U.S. Pat. No. 4,939,980 is directed to a method and apparatus for preventing rotation of bottles in a capping machine while caps are screwed onto bottle necks with capper heads which develop slight axial force. A stationary guide member develops an off-center, mechanical force on the shoulder of the bottle which produces an anti-rotational frictional force at the bottle base while wedging the bottle into frictional engagement with a neck pocket in the capper star wheel.

U.S. Pat. No. 5,095,681 is directed to an apparatus for mounting caps into fluid containers in a predetermined particular orientation relative to the fluid containers. The apparatus includes advancing paddles that tend to prevent the fluid containers, which are generally rectangular in cross section, from rotating, and an operatively associated clamp which supports the fluid containers about a flange around the neck to prevent crushing the fluid container during mounting of the caps.

While these devices generally disclose particular methods for preventing the rotation of a container when a cap or top is being rotatably mounted thereon, U.S. Pat. No. 3,771,284 is more clearly directed to a capping apparatus having features which are particularly pertinent to the improved capping apparatus of the present invention. The capping apparatus disclosed therein includes a cap attachment assembly and a cap tightening turret to be used in conjunction with a container filling turret having a conveying apparatus for transmitting the fluid containers to the cap tightening turret. The cap attachment assembly includes a housing for supporting a cap in the path of the motion of the neck of the container and a pretightener assembly positioned to level the cap on the neck of the container as the cap is pulled from the housing and to impart an initial rotary motion to the cap prior to entering the cap tightening assembly. The cap tightening turret includes a number of spindles having continuously rotating heads and a corresponding number of pedestals for moving the neck of the container into the rotating heads. Each of the heads includes a resilient ring to frictionally engage the outer peripheral of the cap to rotate the cap into tight engagement with the neck of the container. There is a means provided on the spindle head to hold a container in a fixed position while the caps are being tightened onto the necks of the containers. Such means includes a number of fingers secured to a ring provided on the outer periphery of the housing. Although the ring is mounted for possible rotation, the ring is held in a stationary or fixed position when the head rotates. When the containers are moved upward into the spindles, a plurality of fingers are provided for engagement with the side of the containers. If the container starts to turn, the handle on the container will abrupt one of the fingers and is intended to prevent any further rotation of the container. U.S. Pat. No. 3,771,284 is incorporated by reference as if the entirety thereof were included in this application.

U.S. Pat. No. 3,771,284 is assigned to Federal Manufacturing Company of Milwaukee, Wis., which provides a number of similar type of capping devices which are employed by numerous container filling and capping facilities such as those which process milk or other fluids. Such milk or other fluids are supplied in one-half gallon and one gallon container bottles which have an eccentric shape and include an extended handle in the upper region thereof. While the particular configuration of a plurality of fingers, as disclosed in U.S. Pat. No. 3,771,284 and intended to prevent rotation of the container, may still be in use, other bottle capping devices sold by Federal Manufacturing Company may employ a plurality of such fingers for each spindle which may be of a different design but basically configured to provide the same function.

SUMMARY OF THE INVENTION

While the various prior art devices discussed hereinabove include features which may prevent rotation of particularly shaped containers or bottles, the basic capping apparatus of U.S. Pat. No. 3,771,284 is most applicable to the present invention. However, it includes features which have limited the overall effectiveness and reliability of the cap tightening operation thereof. Specifically, the plurality of downwardly depending, light fingers which are intended to prevent rotation of the bottle have not been found to be effective or reliable to any great degree. In fact, the forces produced during the rotation of the cap onto the bottle have caused the fingers to fail during use. If bottles having an eccentric shape are allowed to turn in an uncontrolled manner, they may dislodge adjacent bottles as they spin. When this occurs, the entire line of bottles awaiting cap installation must be shut down until the bottles can be rearranged. Such stoppages are very costly and create concern if they occur too frequently.

In addition to the lack of effectiveness of the plurality of weak fingers found in the prior art, such a configuration presents additional problems during a stoppage, changeover and/or setup for different sized bottles. Because the plurality of fingers extend downwardly from the spindle, the fingers tend to obstruct the efforts of workers who may have to remove damaged bottles or to readjust other bottles within the line. In fact, the use of a plurality of fingers disposed on the spindle toward the outside of the machine have been found to create a danger and to increase the likelihood that a worker's hands might be caught in the moving turret.

It is an object of the present invention to provide an improved cap tightening apparatus that is simple to employ but can effectively prevent the undesired rotation of a container despite the increased forces generated thereon during the application of the cap.

It is another object of the invention to provide such a cap tightening apparatus which does not present any danger to the operator and facilitates the movement of and/or replacement of bottles when the apparatus is shut down.

It is still another object of the invention to provide such a cap tightening apparatus which can accommodate different bottles having handles which are disposed at different radial distances thereon.

These and other objects of the invention are provided in a preferred embodiment thereof including an improved cap tightening turret of the type which includes a plurality of cap tightening spindles. The cap tightening spindles are mounted around the outer periphery of the turret which also includes a number of pedestals for respectively supporting a plurality of containers. Each of the spindles is for supporting a cap with each pedestal for movement of the neck of the container thereon into the spindle for causing the cap therein to be tightened by rotation onto the container. Each of the containers has an outwardly extending handle. The improvement includes a single rotational prevention element mounted on each spindle with the rotational prevention element extending outwardly of the container for circumferential abutting alignment only with the handle thereon.

One aspect of the improved cap tightening turret includes the rotational prevention element being circumferentially located on the spindle toward an interior of the cap tightening turret. The preferred rotational prevention element is formed of steel plate portions having a thickness of about three-sixteenths of an inch and a width of at least one inch.

One embodiment of the improved cap tightening turret is adapted for a first type of container having a handle disposed at a first radial distance thereon and for a second type of container having a handle disposed at a second radial distance thereon. The second radial distance is larger than the first radial distance. The rotational prevention element includes selective adjustment features for selectively adjusting a relative radial position thereof with respect to the spindle. The first of the selective radial positions is for being aligned with the handle of the first type of container and the second of the selective radial positions is for being aligned with the handle of the second type of container. The preferred rotational prevention element is circumferentially located on the spindle toward an interior of the cap tightening turret.

In one aspect of the improved cap tightening turret, the rotational prevention element includes a fixed support element rigidly mounted to the spindle and a selectively movable stop element mounted for movement on the fixed support element. The selective adjustment feature includes the movable stop element being relatively movable on the fixed support element to at least one of the first selective radial position and the second selective radial position. For such a configuration, the fixed support element depends from the spindle and includes a top, a bottom and an intermediate region therebetween. The top is secured to the spindle. The bottom includes a tab extending in an outward direction away from the spindle. The intermediate region includes at least one bolt element extending in the outward direction. The movable stop element depends from the fixed support element and includes a top portion, a bottom portion and an intermediate portion therebetween. The top portion has a slide element for sliding upward and downward movement along the outside of the intermediate region. The sliding element includes at least one vertical slot for receipt of the at least one bolt therein for defining the sliding upward and downward movement between a first vertical position and a second vertical position below the first vertical position. The intermediate portion includes a first notch and a second notch above the first notch. The first notch has a first depth for receipt of the tab therein when the sliding element is at the first vertical position. The second notch has a second depth for receipt of the tab therein when the sliding element is at the second vertical position. There is a retainer on each bolt for retaining the sliding element on the intermediate region of the fixed support element selectively at one of the first vertical position and the second vertical position. The first depth of the first notch is greater than the second depth of the second notch to cause the bottom position of the movable stop element to be at the first radial position when the tab is in the first notch and at the second radial position when the tab is in the second notch.

In another aspect of the improved cap tightening turret, the retainer includes a biasing element for biasing the sliding element toward the intermediate region when the tab is in the first notch, when the tab is in the second notch and throughout the sliding upward and downward movement of the sliding element. The preferred improved cap tightening turret includes two bolts and two vertical slots. The retainer preferably includes a nut on the end of each of the bolts and the biasing element includes a compressed spring on each bolt between the sliding element and the nut. The fixed support element and the selectively movable stop element are formed of steel plate portions having a thickness of about three-sixteenths of an inch and a width of at least one inch.

DESCRIPTION OF THE PREFERRED EMBODIMENT

Figure 1:
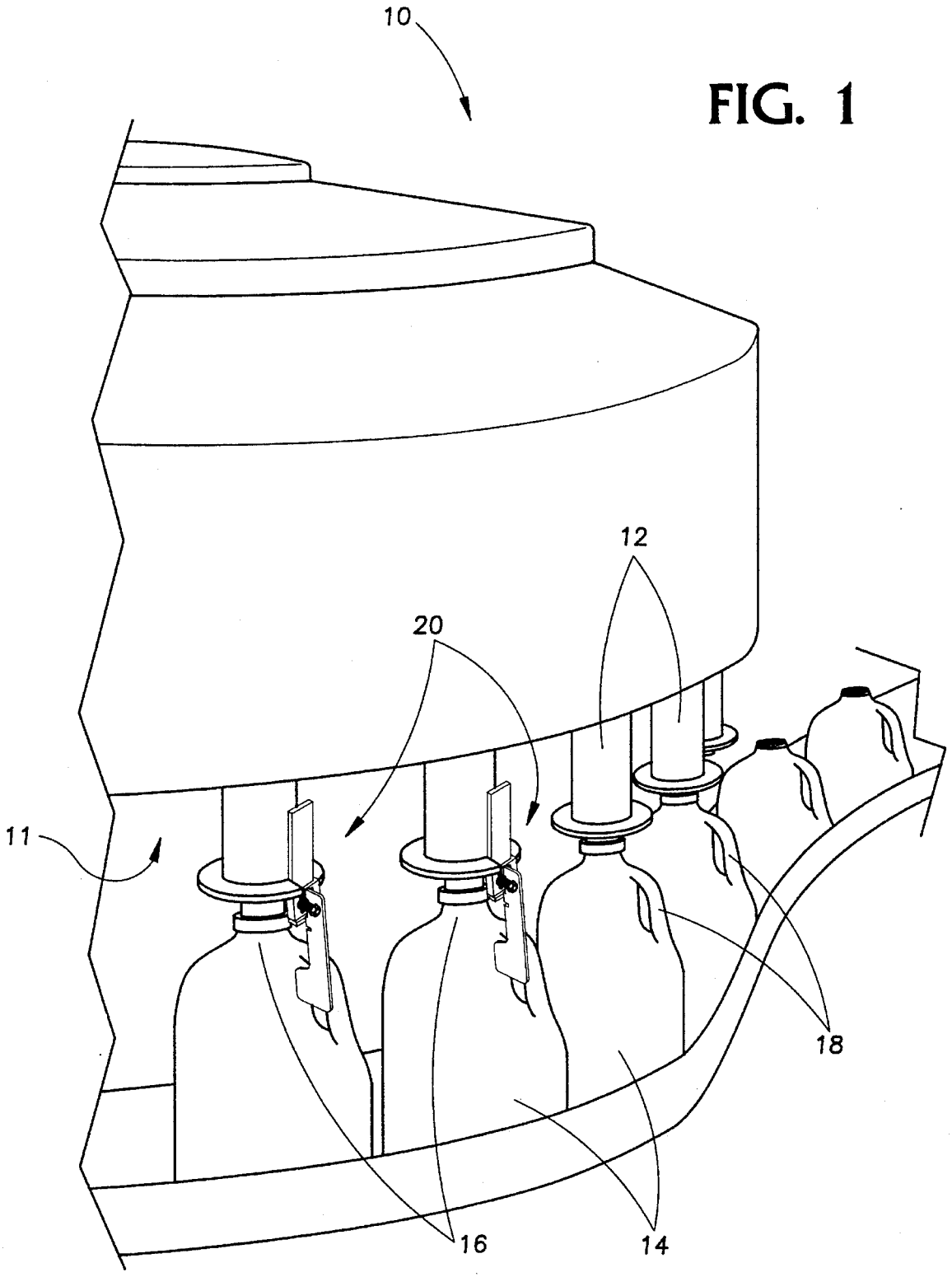
FIG. 1 is a perspective view of a preferred cap tightening turret including various features of the invention.

As seen in FIG. 1, a preferred cap tightening turret 10 includes a plurality of cap tightening spindles 12 mounted around the outer periphery of the underside of the turret 10. The turret 10 also includes a number of pedestals positioned below the turret (not shown) which are intended to respectively support a plurality of containers 14 for advancement around the turret 10. The spindles 12 support a cap (not shown) therein, and each of the pedestals move the neck 16 of each container 14 into the spindle 12, causing the cap therein to be tightened by rotation onto the neck 16 of container 14. The containers 14 are generally cylindrical bottles or jugs which include an extending handle 18. Such bottles or jugs 14 are well known and typically of the types which include milk, juices or other fluids. In the preferred configurations of the present invention, the improved cap tightening turret 10 will accommodate either one-half gallon or gallon jugs 10 of the type which are well known in the prior art. As seen in FIG. 1, the improved cap tightening turret 10 includes a preferred single rotational prevention element 20 mounted on each of the spindles 12. The single rotational prevention element 20 extends toward the container 14 for circumferential abutting alignment only with the handle 18 thereof.

Figure 5:
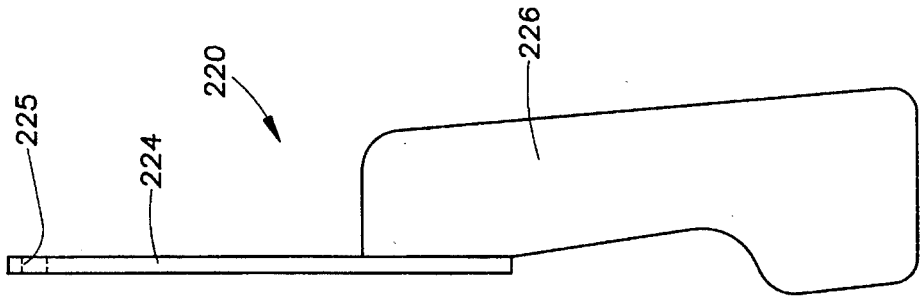
FIG. 5 is a side elevational view of another alternative rotational prevention element similar to that of FIG. 4 but which is intended to prevent the rotation of the large container.
Figure 4:
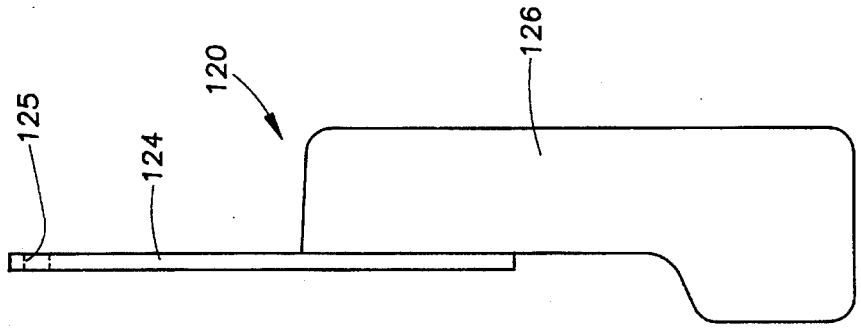
FIG. 4 is side elevational view of an alternative rotational prevention element which is intended to prevent rotation of the smaller container.
Figure 7:
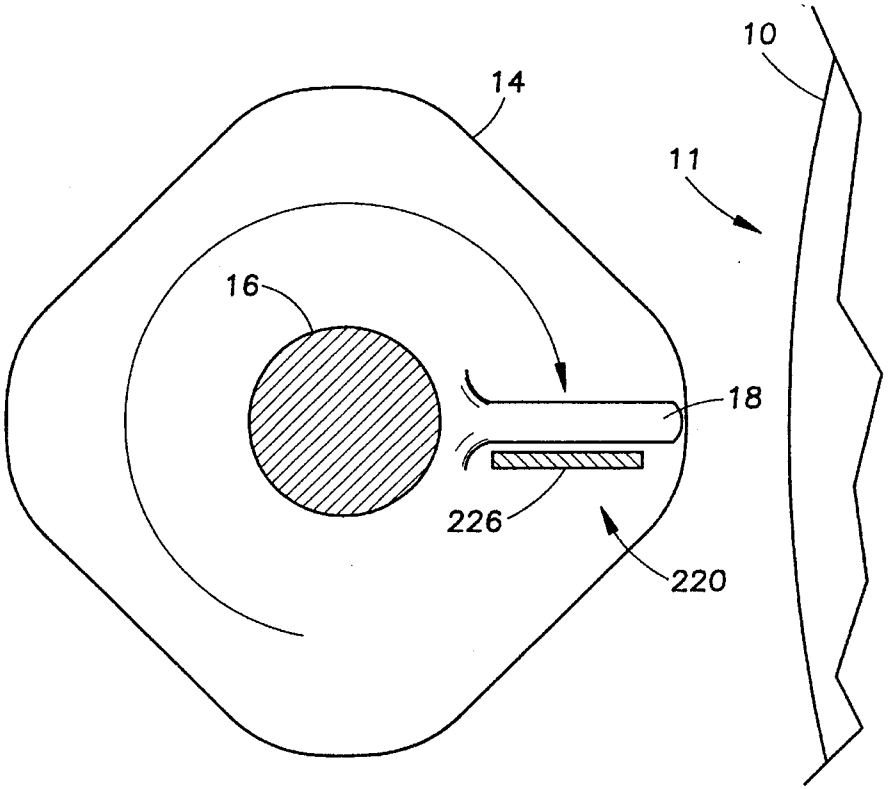
FIG. 7 is a view of the rotational prevention element of FIG. 6 as seen along line 7—7.
Figure 6:
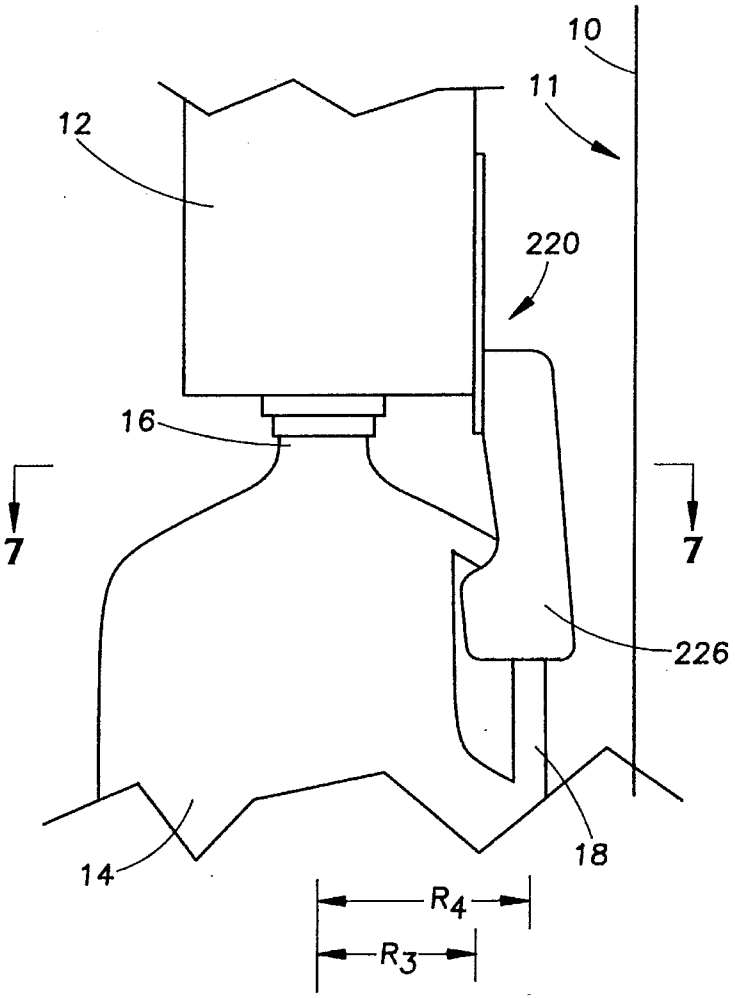
FIG. 6 is a fragmentary, side elevational view of the rotational prevention element of FIG. 5 including various features of the invention applicable to all of the rotational prevention elements disclosed herein.

The preferred rotational prevention element 20 is shown in detail in FIGS. 1, 2, 3 and 8. Alternative rotational prevention elements are shown in FIGS. 4, 5, 6 and 7. As will be seen, the preferred rotational prevention element 20, the alternative rotational prevention elements 120 of FIG. 4 and the alternative rotational prevention element 220 of FIGS. 5, 6 and 7 include similar features and most of the explanations and descriptions of one will be equally appropriate for the others. Basically, the preferred rotational prevention element 20 is intended to accommodate the rotational application of caps to containers 14, having handles 18 which are disposed at different radial distances thereon, such as occurs with one-half gallon containers and one gallon containers. The alternative rotational prevention elements of FIGS. 4, 5, 6 and 7 will effectively allow the application of caps to similar containers; the elements shown in FIG. 4 are specifically adapted for one-half gallon containers, while those shown in FIGS. 5, 6 and 7 are adapted for accommodating one gallon containers 14.

As seen in FIGS. 6 and 7, the rotational prevention element 220 is mounted on a spindle 12 to depend downwardly therefrom toward a large container 14 such as the one gallon jugs mentioned above. The eccentric container 14 is generally cylindrical and includes an extending handle 18 disposed at a radial distance are thereon. Specifically, in FIGS. 6 and 7, the container 14 is a one gallon container and the radial distance R3 is relatively large as compared to a radial distance R4 shown in FIG. 6 for the handle of a one-half gallon container.

The use of a single rotational prevention element (20, 120, or 220 in the various Figures))depending from the spindle 12, independent of its circumferential location thereabout, has significant advantages over the plurality of fingers employed in the prior art cap tightening turrets. However, the overall configuration of such a rotational prevention element 220, as shown in FIGS. 6 and 7, which is circumferentially disposed on the spindle 12 toward the interior 11 of the cap tightening turret 10 is particularly advantageous. A single rotational prevention element 220 allows easier access to a container 14 which is aligned with a spindle 12 if the container must be repositioned or removed. However, locating the single rotational prevention element 220 circumferentially toward the interior 11 of the turret 10 also decreases the likelihood of any worker unintentionally making contact with the rotational prevention element during normal operation of the cap tightening turret 10.

Figure 3:
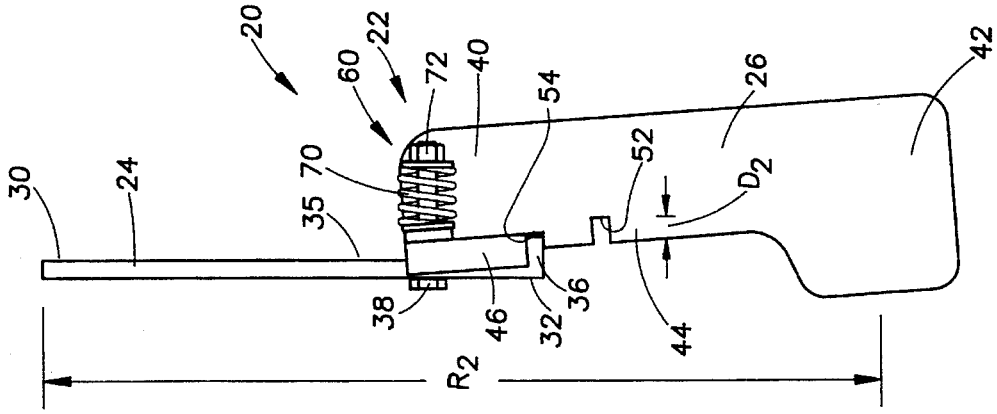
FIG. 3 is a side elevational view of the preferred rotational prevention element of FIG. 2 which is positioned to prevent rotation of a large container.
Figure 2:
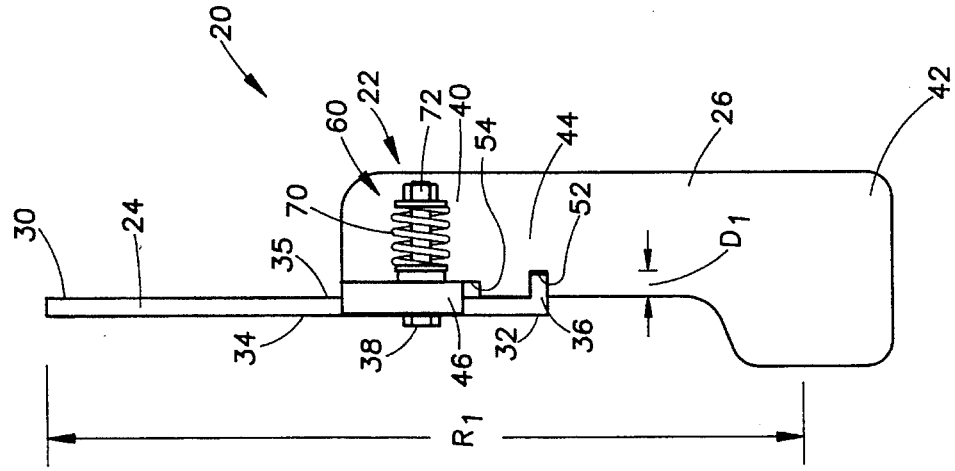
FIG. 2 is a side elevational view of a preferred rotational prevention element which is positioned to prevent rotation of a small container.
Figure 8:
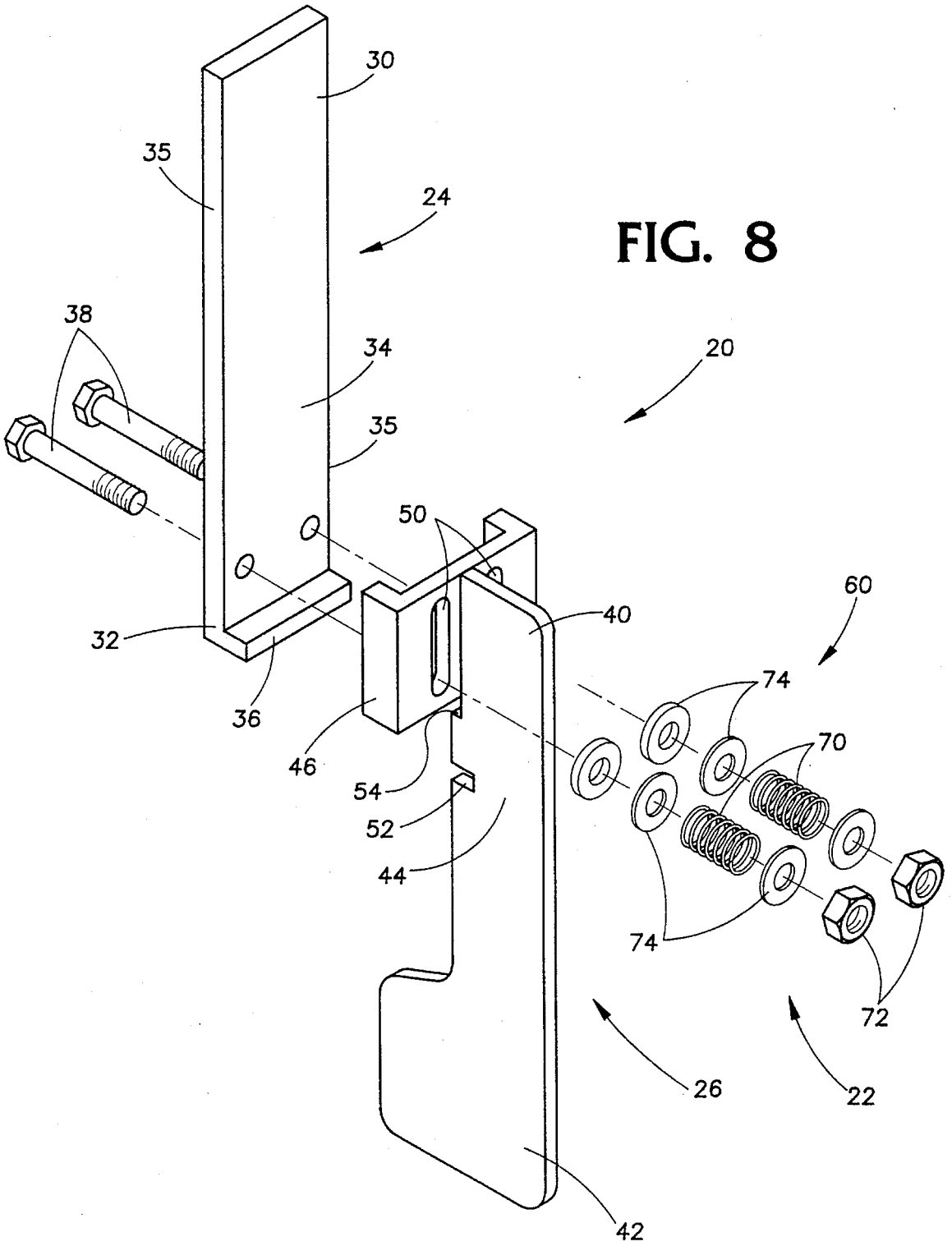
FIG. 8 is a perspective, exploded view of the preferred rotational prevention element of FIGS. 1, 2 and 3.

Because the cap tightening turrets 10 of the present invention are typically employed for both one-half gallon and one gallon containers 14, it is particularly desirable for the preferred rotational prevention element 20 to include a feature for conveniently accommodating each size of container that is being filled and capped. Accordingly, as seen in FIGS. 2, 3 and 8, the preferred rotational prevention element 20 includes selective adjustment means 22 for selectively adjusting the radial position thereof with respect to the spindle 12. As seen in FIG. 2, the rotational prevention element 20 is at a first radial position with respect to the spindle 12 for use on the turret 10 when capping one-half gallon containers 14 having the handle 18 thereof at the first radial distance R1. The preferred rotational prevention element 20, as shown in FIG. 3, is at a second radial position to accommodate the one gallon container 14 with the handle 18 thereof at the second radial distance R2.

The preferred rotational prevention element 20 includes a fixed support element 24 rigidly mounted to each spindle 12 by any means desirable. The element 20 further includes a selectively movable stop element 26 releasably mounted on the fixed support element 24. The selective adjustment means 22 includes the movable stop element 26 being positionable on the fixed support element 24 from the first selective radial position of FIG. 2 to the second selective radial position of FIG. 3. The fixed support element 24 depends from the spindle 12 and includes a top 30, a bottom 32 and an intermediate region 34 therebetween. The top 30 is rigidly secured to the spindle 12 in any suitable manner. The bottom 32 includes a tab 36 extending in an outward direction away from the spindle 12. The intermediate region 34 includes bolt means, preferably in the form of two bolts 38, extending through bottom 32 of element 24 in an outward direction.

The movable stop element 26 depends from the fixed support element 24 and includes a top portion 40, a bottom portion 42 and an intermediate portion 44 therebetween. The top portion 40 has a slide element 46 for sliding upward and downward movement along the outside edges 35 of the intermediate region 34 of the fixed support element 24. The slide element 46 includes vertical slot means, preferably in the form of two vertical slots 50, for receipt of the bolts 38 therethrough, for defining the sliding upward and downward movement between a first vertical position of FIG. 2 and a second vertical position of FIG. 3 which is below the first vertical position. The intermediate portion 44 includes a first notch 52 and a second notch 54 above the first notch 52. The first notch 52 has a first depth D1 (FIG. 2) for receipt of the tab 36 therein whenever the sliding element 46 is at the first vertical position of FIG. 2. The second notch 54 has a second depth D2 (FIG. 3) for receipt of the tab 36 therein whenever the sliding element 46 is at the second vertical position of FIG. 3.

There is provided retaining means 60 on the bolts 38 for releasably retaining the slide element 46 against the intermediate region 34 of the fixed support element 24 selectively at the first vertical position and at the second vertical position. The first depth D1 of the first notch 52 is greater than the second depth D2 of the second notch 54 causing the bottom portion 42 of the movable stop element 26 to be at the first radial position of FIG. 2 when the tab 36 is in the first notch 52, and causing the bottom portion 42 to be at the second radial position of FIG. 3 when the tab 36 is in the second notch 54.

In the preferred rotational prevention element 20, the retaining means 60 includes biasing means, in the form of two compressible elastic springs 70, for biasing the slide element 46 toward the intermediate region 34 both when the tab 36 is in the first notch 52 and when the tab 56 is in the second notch 54, as well as during any sliding upward and downward movement of the slide element 46.

As seen in FIG. 8, the preferred rotational prevention element 20 includes two bolts 38 and two vertical slots 50. The retaining means 60 includes a nut 72 on the end of each bolt 38. The spring 70 is on each bolt 38 between the slide element 46 and the nut 72. There is also provided a plurality of washer elements 74 to facilitate the sliding movement of the slide element 46 and to maintain the position of the springs 70 throughout such movement. The washer elements 74 may be of different sizes and thicknesses.

The preferred rotational prevention element 20 preferably includes the fixed support element 24 and the movable stop element 26, with the slide element 46 thereof, being formed of steel plate portions having a thickness of about three-sixteenths of an inch and a width of at least one inch in order to provide the overall rigidity and strength to insure proper operation of the rotational prevention element 20 of the improved cap tightening turret 10.

As thus described, the preferred rotational prevention element 20 can be quickly and conveniently adjusted for either of the types of bottles discussed hereinabove. To change the radial position from that of FIG. 2, the lower portion 42 of the stop element 26 is simply pushed outward and the slide element 46 is caused to slide downward for alignment of the tab 36 with the notch 54. Similarly, to adjust the position from that shown in FIG. 3 for the gallon bottles, the lower portion 42 is pushed outward against the biasing of the springs 70 to release the tab 36 from the notch 54. The stop element 26 is then slid upwardly until the tab 36 is aligned with the notch 52 for repositioning to accommodate the one-half gallon bottles. The easy adjustment of the rotational prevention element 20 is appropriate for any improved cap tightening turret 10 which may be frequently converted for capping the one-half gallon bottles or the one gallon bottles.

On the other hand, if the improved cap tightening turret 10 is intended to be utilized for long filling runs of either the one-half gallon bottle and/or the one gallon bottle, one of the rotational prevention elements 120 or 220 of FIGS. 4 and 5 may be more appropriate.

As seen in FIG. 4, the alternative rotational prevention element 120 includes a support element 124 having bolt hole means 125 for mounting to the spindle 12. The stop element 126 thereof is welded or otherwise rigidly secured to the support element 124 for producing a radial position of the lower end thereof in alignment with the handle of a one-half gallon bottle.

As seen in FIG. 5, the alternative rotational prevention element 220 includes the rigid support element 224 having bolt holes 225 therethrough for attachment to the spindle 12. The stop element 226 is rigidly mounted on the support element 224 and includes a radial position which is appropriate for alignment with the larger one gallon bottles in the manner described hereinabove.

The improved cap tightening turret could be utilized in conjunction with either of the rotational prevention elements 120 or 220. Accordingly, if the filling runs are expected to be of a long duration, simply bolting the appropriate rotational prevention element 120 or 220 to the spindle 12 will allow a simple adaptation for either size bottle. An advantage of the use of two such rotational prevention elements 120 and 220 is that the simple construction thereof simplifies cleaning and is clearly less expensive to provide. In either case, the support elements 124 and 224 and the stop elements 126 and 226 are both preferably made of steel plate portions having a thickness of about three-sixteenths of an inch and a width of at least one inch in order to provide the overall desired rigidity needed to prevent the undesired rotation of the containers to be capped in the improved cap tightening turret.

While the invention has been herein described by way of particular preferred embodiments, various substitutions of equivalence may be effected without departing from the spirit and scope of the invention as set forth in the following claims.

What is claimed is:

1. An improved cap tightening turret of the type which includes a plurality of cap tightening spindles, the cap tightening spindles being mounted around an outer periphery of the turret, a number of pedestals for respectively supporting a plurality of containers, each of the spindles for supporting a cap with each pedestal for movement of the neck of the container thereon into the spindle for causing the cap therein to be tightened by rotation onto the container, and each of the containers having an outwardly extending handle thereon, said improvement comprising:

a single rotational prevention element mounted on each spindle;

said rotational prevention element extending toward the container for circumferential abutting alignment only with the handle thereof:

said rotational prevention element is circumferentially located on the spindle toward an interior of the cap tightening turret;

said rotational prevention element is formed of steel plate portions having a thickness of about three-sixteenths of an inch and a width of at least one inch;

a first type of container has the handle disposed at a first selective radial distance thereon;

a second type of container has a handle disposed at a second radial distance thereon;

the second radial distance is larger than the first radial distance;

said rotational prevention element includes selective adjustment means for selectively adjusting a relative radial position thereof with respect to the spindle;

a first of said selective radial positions is for being aligned with the handle of the first type of container; and a second of said selective radial positions is for being aligned with the handle of the second type of container.

2. The improved cap tightening turret according to claim 1, wherein said rotational prevention element is circumferentially located on the spindle toward an interior of the cap tightening turret.

3. The improved cap tightening turret according to claim 1, wherein said rotational prevention element includes a fixed support element rigidly mounted to the spindle and a selectively movable stop element mounted for movement on said fixed support element and said selective adjustment means includes said movable stop element being relatively movable on said fixed support element to at least one of said first selective radial position and said second selective radial position.

4. The improved cap tightening turret according to claim 3, wherein:

said fixed support element depends from the spindle and includes a top, a bottom and an intermediate region therebetween;

said top is secured to the spindle;

said bottom includes a tab extending in an outward direction away from the spindle;

said intermediate region includes bolt means extending in said outward direction;

said movable stop element depends from said fixed support element and includes a top portion, a bottom portion and an intermediate portion therebetween;

said top portion has a slide element for sliding upward and downward movement along an outside of said intermediate region;

said slide element includes vertical slot means for receipt of said bolt means therethrough for defining said sliding upward and downward movement between a first vertical position and a second vertical position below the first vertical position;

said intermediate portion includes a first notch and a second notch above said first notch;

said first notch has a first depth for receipt of said tab therein when said sliding element is at said first vertical position;

said second notch has a second depth for receipt of said tab therein when said slide element is at said second vertical position;

retaining means on said bolt means is for retaining said sliding element on said intermediate region of said fixed support element selectively at one of said first vertical position and said second vertical position; and said first depth of said first notch is greater than said second depth of said second notch to cause said bottom portion of said movable stop element to be at said first radial position when said tab is in said first notch and at said second radial position when said tab is in said second notch.

5. The improved cap tightening turret according to claim 4, wherein said retaining means includes biasing means for biasing said slide element toward said intermediate region when said tab is in said first notch, when said tab is in said second notch, and throughout said sliding upward and downward movement of said slide element.

6. The improved cap tightening turret according to claim 5, wherein said bolt means includes two bolts and said vertical slot means includes two vertical slots.

7. The improved cap tightening turret according to claim 6, wherein said retaining means includes a nut at an extended end of each of said bolts and said biasing means includes a compressed spring on said each bolt between said slide element and said nut.

8. The improved cap tightening turret according to claim 4, wherein said fixed support element and said selectively movable stop element are formed of steel plate portions having a thickness of about three-sixteenths of an inch and a width of at least one inch.

9. An improved cap tightening turret of the type which includes a plurality of cap tightening spindles, the cap tightening spindles being mounted around an outer periphery of the turret, a number of pedestals for respectively supporting a plurality of containers, each of the spindles for supporting a cap with each pedestal for movement of the neck of the containers thereon into the spindle for causing the cap therein to be tightened by rotation onto the container, each of the containers having an outwardly extending handle, a first type of container having the handle thereof disposed at a first radial distance thereon and a second type of container having a handle thereof disposed at a second radial distance thereon, and the second radial distance being larger than the first radial distance, said improvement comprising:

a single rotational prevention element mounted on each spindle;

said rotational prevention element extending toward the container for circumferential abutting alignment only with the handle thereof;

said rotational prevention element being circumferentially located on the spindle toward an interior of the cap tightening turret;

said rotational prevention element including selective adjustment means for selectively adjusting a relative radial position thereof with respect to the spindle;

a first of said selective radial positions for being aligned with the handle of the first type of container;

a second of said selective radial positions for being aligned with the handle of the second type of container;

said rotational prevention element including a fixed support element rigidly mounted to the spindle;

said rotational prevention element including a selectively movable stop element mounted for movement on said fixed support element;

said selective adjustment means including said movable stop element being relatively movable on said fixed support element to at least one of said first selective radial position and said second selective radial position;

said fixed support element depending from the spindle and including a top, a bottom and an intermediate region therebetween;

said top being secured to the spindle;

said bottom including a tab extending in an outward direction away from the spindle;

said intermediate region including bolt means extending in said outward direction;

said movable stop element depending from said fixed support element and including a top portion, a bottom portion and an intermediate portion therebetween;

said top portion having a slide element for sliding upward and downward movement along an outside of said intermediate region;

said slide element including vertical slot means for receipt of said bolt means therethrough for defining said sliding upward and downward movement between a first vertical position and a second vertical position below said first vertical position;

said intermediate portion including a first notch and a second notch above said first notch;

said first notch having a first depth for receipt of said tab therein when said slide element is at said first vertical position;

said second notch having a second depth for receipt of said tab therein when said slide element is at said second vertical position;

retaining means on said bolt means for retaining said slide element on said intermediate region of said fixed support element selectively at one of said first vertical position and said second vertical position;

said first depth of said first notch being greater than said second depth of said second notch to cause said bottom portion of said movable stop element to be at said first radial position when said tab is in said first notch and at said second radial position when said tab is in said second notch; and said retaining means including biasing means for biasing said slide element toward said intermediate region when said tab is in said first notch, when said tab is in said second notch, and throughout said sliding upward and downward movement of said slide element.

10. The improved cap tightening turret according to claim 9, wherein said bolt means includes two bolts and said vertical slot means includes two vertical slots.

11. The improved cap tightening turret according to claim 10, wherein said retaining means includes a nut at an extended end of each of said bolts and said biasing means includes a compressed spring on said each bolt between said slide element and said nut.

12. The improved cap tightening turret according to claim 9, wherein said fixed support element and said selectively movable stop element are formed of steel plate portions having a thickness of about three-sixteenths of an inch and a width of at least one inch.

* * * * *